US006462714B1

(12) United States Patent
Okabe et al.

(10) Patent No.: US 6,462,714 B1
(45) Date of Patent: Oct. 8, 2002

(54) WIRELESS HANDSET USING A SLOT ANTENNA

(75) Inventors: Hiroshi Okabe, Kokubunji; Ken Takei, Kawasaki, both of (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/791,857

(22) Filed: Feb. 26, 2001

(30) Foreign Application Priority Data

Sep. 1, 2000 (JP) ..... 2000-269877

(51) Int. Cl.[7] ..... H01Q 13/10; H01Q 1/38
(52) U.S. Cl. ..... 343/767; 343/700 MS
(58) Field of Search ..... 343/767, 770, 343/776, 769, 780, 702, 700 MS; H01Q 13/10, 1/38

(56) References Cited

U.S. PATENT DOCUMENTS 5,489,913 A * 2/1996 Ranuenet et al. ..... 343/767
5,850,198 A * 12/1998 Lindenmeier et al. ..... 343/713
5,914,693 A * 6/1999 Takei et al. ..... 343/767
5,977,924 A * 11/1999 Takei et al. ..... 343/770
6,018,320 A * 1/2000 Jidhage et al. ..... 343/700 MS
6,028,561 A * 2/2000 Takei ..... 343/767
6,034,644 A * 3/2000 Okabe et al. ..... 343/767
6,188,369 B1 * 2/2001 Okabe et al. ..... 343/767
6,218,997 B1 * 4/2001 Lindenmeier et al. ..... 343/725

* cited by examiner

*Primary Examiner*—Don Wong
*Assistant Examiner*—Trinh Vo Dinh
(74) *Attorney, Agent, or Firm*—Antonelli, Terry, Stout & Kraus, LLP

(57) ABSTRACT

In order to make a wireless handset smaller, a novel slot antenna is provided which can simplify the manufacture process and can be connected to a tunable circuit. A slot is disposed in a narrow side surface of a conductive cube, and a power supply conductor is arranged in the slot so as to intersect the slot. A variable impedance circuit is connected between conductors on opposite edges of the slot in a position at a constant distance from one of the ends of the slot. The control signal varies impedance of the variable impedance circuit so as to control the resonant frequency of the antenna. Transmit/receive antennas are connected by a support so as to align the directions of the main polarizations, and then are arranged on the circuit board of the wireless handset.

19 Claims, 7 Drawing Sheets

WIRELESS HANDSET USING A SLOT ANTENNA

BACKGROUND OF THE INVENTION

The present invention relates to a wireless handset using a slot antenna. More specifically, it relates to a wireless handset for use in a communication system switching a plurality of call frequencies and employing different transmit/receive frequencies, in particular, a wireless handset mounting a slot antenna.

DESCRIPTION OF THE RELATED ART

Wireless handsets have been made smaller and thinner in order to improve portability, and at the same time, various small antennas mounted on such wireless handsets have been developed. Among them, a slot antenna utilizing a coaxial resonator can be incorporated without any protrusion, and in particular, Japanese Non-examined Patent Publication No. 9-74312 proposes a coaxial resonant slot antenna which is made smaller in which its central conductor (power supply conductor) is not in contact with a resonator case (conductive cubic). This coaxial resonant slot antenna is a magnetic current type antenna, and there is an influence between the magnetic current generated in the slot and a magnetic current in the same phase generated on a surface opposite a main surface provided with the slot in the conductive cubic, so as to realize single-side directional. Since an electromagnetic wave having frequencies above about 2 GHz can easily be absorbed into the head of the user in a call state of the handset, a single-side directional antenna which allows no electric power to be radiated to the user side is used to reduce power consumption. Similarly, in respect of received power, the single-side directional also increases antenna gain on the opposite side of the head to enhance handset sensitivity.

Since the antenna includes a resonator construction, the volume is directly proportional to the bandwidth. Thus, when the antenna is applied to a handset of broad bandwidth wireless communication system having a large capacitance using a plurality of carrier frequencies, the bandwidth to be provided for the antenna is expanded, and the antenna volume is increased.

Generally, a bandwidth for use in the call between a specific base station and a wireless handset is much narrower than that of the whole system. For each call, the resonant frequency of the antenna is suitably changed to the frequency for use in the call. The bandwidth to be provided for the antenna is reduced, so as to reduce the antenna volume. For this reason, in the slot antenna utilizing a coaxial resonator, Japanese Non-examined Patent Publication No. 11-46115 proposes a tunable slot antenna comprising at least one island conductor provided in a slot, wherein a variable capacitance circuit changes a capacitance value between the island conductor and the wall surface of a conductive cubic, so as to extensively vary the resonant frequency of the antenna. The construction example thereof is shown in FIG. 14.

The antenna comprises a narrow strip conductor 40 disposed in the resonant axial direction of the inner space of a conductive cubic 1 of generally rectangular parallelepiped and so as to be insulated from the conductive cubic 1, and an electric wave transmit/receive slot 2 formed in the top surface of the conductive cubic 1 so as to intersect the strip conductor 40, in which a radio frequency power supply circuit 7 supplies radio frequency power through a power supply conductor 5 and an island conductor 6 between a connection portion 41 set in the strip conductor 40 and the wall surface of the conductive cubic 1.

An island conductor 42 is provided in the slot 2 so as to be insulated from the conductive cubic 1, and a variable capacitance circuit 10 connected between the island conductor 42 and the wall surface of the conductive cubic 1 is connected through a control line 50 to a control circuit 30. The control signal from the control circuit 30 varies the capacity value of the variable capacitance circuit 10, so as to change the capacitance value between the strip conductor 40 and the wall surface of the conductive cubic 1 through the island conductor 42, or between the island conductor 42 and the wall surface of the conductive cubic 1. When the capacitance value between the strip conductor 40 and the wall surface of the conductive cubic 1 is varied through the island conductor 42, the electric current phase on the strip conductor 40 just below the slot 2 is changed. The length of the strip conductor 40 associated with the resonant frequency of the coaxial resonant slot antenna is varied equivalently.

When varying the capacitance value between the island conductor 42 and the wall surface of the conductive cubic 1 as ground potential, for example, if the capacitance value is enough large, the potential of the island conductor 42 is almost equal to the potential of the wall surface of the conductive cubic 1 as ground potential, so as to equivalently reduce the width of the slot 2 by the size of the island conductor 42. Partial reduction of the width of the slot 2 corresponds to an increase in the length of the slot 2. Consequently, the capacitance value of the variable capacitance circuit 10 is varied, so as to equivalently change the length of the slot 2 associated with the resonant frequency of the coaxial resonant slot antenna.

The matching conditions of the tunable slot antenna can be determined by both the electric current phase on the strip conductor 40 just below the slot 2 and the length of the slot 2. Increasing the capacitance value can equivalently increase both the strip conductor length and the slot length, thereby maintaining the matching conditions of the antenna. According to the foregoing principle, the antenna simultaneously and equivalently varies the length of the strip conductor just below the slot and the slot length, so as to extensively change the resonant frequency of the antenna while maintaining the impedance matching state of the antenna.

SUMMARY OF THE INVENTION

In the conventional tunable slot antenna proposed in Japanese Non-examined Patent Publication No. 11-46115 described above, since the strip conductor 40 is provided in the conductive cubic 1, the manufacturing process is complex, and the manufacture cost is high.

Further, since the island conductor 42 is provided so as to intersect the strip conductor 42 in the conductive cubic 1, the island conductor 42 must be disposed near the central portion of the slot 2. The variable capacitance circuit 10 connected to the island conductor 42 disposed near the central portion of the slot 2 must be also disposed near the central portion of the slot 2, that is, in the central portion of the antenna. In order to add a control signal to the variable capacitance circuit 10 present in the central portion of the antenna, the control line 50 is provided toward the central portion of the antenna. However, since most electric power is radiated from the slot 2 of the slot antenna, the radiated power is reduced depending on the routing of the control line 50. In Japanese Non-examined Patent Publication No.

11-46115 described above, there is also described a method of applying a DC voltage from one end near the slot 2 of the strip conductor 40 through the through hole and high resistance element to the island conductor 42. According to this method, a control signal can be applied to the island conductor 42 without reducing radiated power. There are, however, the following two problems.

One of the problems is that, when the variable capacitance circuit 10 is a circuit continuously varying the capacitance value with a DC voltage value, and a radio frequency power value inputted to the antenna is increased, the radio frequency power coupled to the island conductor 42 is superimposed on a DC voltage applied to the variable capacitance circuit 10 and the capacitance value is inconstant, and the resonant frequency of the tunable antenna is inconstant. For this reason, when the circuit continuously varying the capacitance value by the DC voltage value is used as the variable capacitance circuit 10, the conventional tunable slot antenna can handle only a small signal, such as a receiving signal of a digital cellular handset.

The other problem is that, when the variable capacitance circuit 10 is a circuit switching between two states of connection/non-connection of the capacitance element by the DC voltage value, the strip conductor 40 also serves as the control line, so that the number of control lines is limited to one, and the resonant frequency realized is also limited to have two values It is thought that one control line can switch a plurality of capacitance elements, but in order to realize this, a complex logic circuit is required, which is disadvantage in view of the packaging density and cost in the case of constructing the wireless handset.

Accordingly, it is an object of the present invention to provide a wireless handset which can package a slot antenna capable of reducing the manufacture cost and packaging cost, and handle a signal of relatively high electric power.

It is another object of the present invention to provide a wireless handset incorporating an antenna, which is small and of high performance for use in a communication system switching a plurality of call frequencies and employing different transmit/receive frequencies.

In order to achieve the foregoing objects, the wireless handset of the present invention comprises a circuit board having a ground plane and a side surface slot antenna packaged in the circuit board. The side surface slot antenna comprises a flat conductive cubic covered with a conductor, a slot having its main portion formed in the side surface of the conductive cubic, a power supply conductor disposed in the slot in the direction intersecting the longitudinal direction of the slot, and a power supply portion for supplying AC power to one of the ends of the power supply conductor.

In a preferred embodiment of the side surface slot antenna, a first island conductor is provided in a portion in which one portion of the slot is extended to the lower surface of the conductive cubic so as not to be in contact with the lower surface of the conductive cubic, and one end of the power supply conductor is connected to the first island conductor, so as to supply AC power through the first island conductor between one end of the power supply conductor and the conductor of the lower surface of the conductive cubic. A variable impedance circuit is connected between the conductor of the single edge of the slot of the top surface of the conductive cubic and the conductor of the lower surface of the conductive cubic in a first position at a constant distant from one of the ends of the slot or opposite ends to the other end along the slot. The variable impedance circuit is connected to a control circuit for varying impedance of the variable impedance circuit.

In a further preferred embodiment of the present invention, when the side surface slot antenna is mounted on the circuit board of the wireless handset, a ground conductor and a plurality of island conductors formed so as not to be in contact with the ground conductor are provided in the surface of the circuit board mounting the slot antenna, the conductor of the lower surface of the conductive cubic is connected to the ground conductor on the circuit board, the plurality of island conductors provided in the lower surface of the conductive cubic are connected to the respective island conductors on the circuit board, so as to supply AC power between the island conductor on the circuit board connected to the first island conductor and the ground conductor on the circuit board, and to connect the first variable impedance circuit between the island conductor on the circuit board connected to the second island conductor, which is formed in the surface of the conductive cubic so as to not to be in contact with the conductor and electrically connected with the single edge of the slot of the top surface of the conductive cubic in the first position, and the ground conductor on the circuit board.

According to the wireless handset of the present invention, an electric wave is radiated efficiently in the direction vertical to the circuit board surface in relation to the ground plane of the circuit board, and the power supply conductor is provided in the side surface of the conductive cubic in the direction orthogonal to the top surface of the conductive cubic. The electric current of the power supply conductor is in parallel with the direction vertical to the top surface of the conductive cubic which is the electric power radiation direction of the side surface slot antenna, and cannot affect the radiated power. Further, since the side surface slot antenna requires no multi-layer construction manufacture process for providing the power supply conductor in the conductive cubic, the manufacture cost can be reduced. In the form for providing the variable impedance circuit at the end of the slot, the impedance is varied so as to vary the resonant frequency of the antenna. In addition, since the position in which the variable impedance circuit is connected is close to the end of the slot, it is possible to dispose a circuit for varying the resonant frequency and the control line for this circuit in the position away from near the central portion of the slot having the largest radiated power of the antenna, without greatly affecting the radiated power.

In order to achieve the objects of the present invention, the wireless handset of the present invention for use in a communication system switching a plurality of call frequencies and employing different transmit/receive frequencies, comprises a circuit board having in its interior a ground plane, and slot antennas of the present invention for transmit and receive, independently, wherein the transmit/receive slot antennas are integrally formed by interposing a support therebetween so as to align the directions of the main polarizations, and then the integration is mounted such that the lower surface of the conductive cubic of each of the transmit/receive antennas is directed to the surface of the circuit board facing the opposite side of the user when using the wireless handset.

According to the wireless handset of the present invention, since the volume is typically proportional to the bandwidth in the antenna, as compared with the volume of the antenna having a bandwidth covering all the transmit/receive bandwidths provided by interposing the transmit/receive isolation bandwidth, the volume of the antenna covering the transmit/receive bandwidths can be reduced by more than half. The total antenna volume can be reduced, so that the wireless handset incorporating the antenna can be smaller. The directions of the main polarizations of transmit/receive antennas are aligned in the direction of the polarization for use in the system employing the wireless handset mounting the antenna, whereby transmit/receive can efficiently be performed, Since the distance between the transmit/receive antennas can be maintained constant by the support, an amount of isolation between the transmit/receive antennas isolated is constant regardless of how to mount the antenna, thereby giving stable properties.

Since the slot antenna of the present invention is a magnetic current type antenna, the slot antenna is mounted on the surface of the circuit board having in its interior a ground plane facing the opposite side of the user when using the wireless handset, whereby electric power can effectively be radiated to the side opposite the user. In addition, it is possible to package the circuit in the wireless handset case of the wireless handset user side viewed from the antenna, such that the packaging density can be high so as to make the wireless handset smaller. Since the side surface slot antenna is of single-layer flat construction, the transmit/receive slot antennas and the support can easily be integrally formed, so that the manufacture cost can be reduced as compared with the case where the transmit/receive antennas are manufactured independently to be combined. When the transmit/receive antennas are connected by the support such that the magnetic currents are aligned in a straight line, the coupling between the transmit/receive antennas is minimum, and it is possible to reduce leak of a signal from the transmit radio frequency circuit to the receive radio frequency circuit in the wireless handset for performing transmit/receive at the same time.

Other features and effects of the wireless handset of the present invention and the preferred embodiments of the side surface slot antenna and the effects thereof will be described in detail in the following embodiments of the present invention.

DESCRIPTION OF THE PREFERRED EMBODIMENTS

Embodiments of the side surface slot antenna (hereinafter, simply referred to as a slot antenna) according to the present invention and the wireless handset using the same will be described hereinafter. The same numerals of FIGS. 1 to 12 denote identical items or similar items.

Embodiment 1

Figure 1:
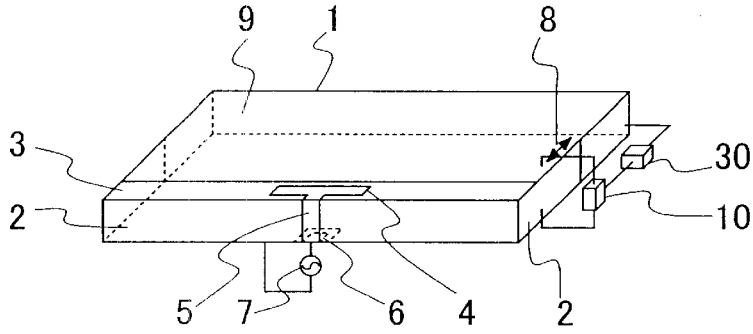
FIG. 1 is a perspective view of assistance in explaining a first embodiment of a slot antenna according to the present invention.

FIG. 1 shows a perspective view of one embodiment of a slot antenna for use in a wireless handset according to the present invention. As illustrated, the slot antenna comprises a conductive cubic 1 having its top, lower and side surfaces covered with a conductor, a slot 2 formed by narrowly removing one portion of the conductor of the conductive cubic 1, and a power supply conductor 5 insulated from the conductor of the conductive cubic 1 and disposed in the direction intersecting the longitudinal direction of the slot 2, so as to supply AC power between one of the ends of the power supply conductor 5 and the conductor of the conductive cubic 1, the slot 2 being formed in a shape including the part in which one portion is removed from the side surface of the conductive cubic 1.

In other words, the slot 2 is formed by leaving the conductor in at least one portion of the conductive cubic 1 such that the conductor of the top surface of the conductive cubic 1 is connected to the conductor of the lower surface thereof. The slot 2 includes a slot god extension portion 3 contiguous to the slot 2 in which there is removed one portion not only of the side surface but also of a top surface 9 side of the conductive cubic 1. The power supply conductor 5 is provided in the slot in the direction intersecting the longitudinal direction of the slot 2, one of the ends thereof being connected to a first island conductor 6 in the lower surface portion of the conductive cubic 1 so as not to be in contact with the lower surface conductor, the other end being connected to a matching conductor 4 provided in the slot extension portion 3. Between the first island conductor 6 and the lower surface conductor of the conductive cubic, is connected a power supply circuit 7 for supplying radio frequency power in which the first island conductor 6 is a power supply point, and the wall surface of the conductive cubic 1 is a ground potential. An insulator for supporting the conductor such as the power supply conductor 5 is filled in the conductive cubic 1.

The slot 2 is excited by the power supply conductor 5 intersecting the slot and the matching conductor 4, and is resonated at a frequency in which the entire length of the slot provided in the side surface of the conductive cubic 1 is a substantially ½ wavelength. A variable impedance circuit 10 has a pair of terminals with varied impedance between the terminals being connected, respectively, to opposite edges of the slot in a first position at a constant distance 8 from one of the ends of slot 2 to the other end along the slot, and then a control terminal for varying impedance between the terminals is connected to a control circuit 30. The control signal supplied from the control circuit 30 is varied, so as to change impedance between the conductors on opposite edges of the slot in the first position, thereby varying the resonant frequency of the antenna.

According to this construction, since the strip conductor in the conductive cubic is unnecessary, though it is needed for the conventional coaxial resonant slot antenna, a process for making multi-layers for conductive layers at manufacture is not required, thereby reducing the manufacture cost. The impedance matching state of this antenna can be determined by the capacitance value between the end portion of the power supply conductor 5 provided in the side surface of the conductive cubic 1 closer to the top surface 9 of the conductive cubic 1 and the slot end conductor of the top surface 9 side of the conductive cubic 1. There is provided the matching conductor 4 connected to the end portion of the power supply conductor 5 closer to the top surface 9 of the conductive cubic 1. There are varied the length of the matching conductor 4 and the gap between the matching conductor 4 and the slot edge of the top surface 9 side of the conductive cubic 1, thereby easily adjusting the impedance matching state of the slot antenna. The matching conductor 4 may be provided in the side surface of the conductive cubic 1, but, as in this embodiment, is provided in the slot extension portion 3 for extending the slot 2 to the top surface 9 side of the conductive cubic 1. Conductive pattern formation is easier in the top surface of the conductive cubic than in the side surface thereof, so that the size accuracy is improved and variations in the impedance matching state can be reduced. When the conductor of the top surface of the conductive cubic is removed near the power supply conductor and the matching conductor is provided in the slot extension portion of the slot, the matching conductor can be formed in the top surface of the conductive cubic in which the conductive pattern formation is easy. There can be improved the size accuracy of the length of the matching conductor or the gap between the matching conductor and the slot edge, thereby reducing variations in the impedance matching state.

The matching conductor provided in the top surface of the conductive cubic provides an open end, since the matching conductor is connected to the other end opposite one end for power supply of the power supply conductor. Since the amplitude of the electric current in the open end is minimum, the electric current of the matching conductor is very small, and the matching conductor is formed in the top surface of the conductive cubic in the power radiation direction of the slot antenna, with almost no influence on the radiated power.

According to this construction, the impedance of the variable impedance circuit is varied so as to change the resonant frequency of the antenna. The position to which the variable impedance circuit is connected is close to the slot end, and the circuit for varying the resonant frequency and the control line for this circuit can be disposed in the position away from near the central portion of the slot having the largest radiated power in the antenna. The radiated power cannot greatly be affected.

Further, according to this construction, the variable impedance circuit 10 for varying the resonant frequency and the control line for the variable impedance circuit can be disposed in the position away from near the central portion of the slot having the largest radiated power of the antenna. The resonant frequency can be varied without greatly affecting the radiated power.

The antenna construction may be of flat, thin plane construction, as in the conventional coaxial resonant slot antenna, and is mounted on the radio frequency circuit board of the wireless handset, thereby providing a built-in antenna construction without any external protrusion.

In the antenna of this constriction, the specific dielectric constant of the dielectric material filled in the conductive cubic 1 is increased to reduce the antenna size, as in the conventional tunable slot antenna proposed in Japanese Non-examined Patent Publication No. 11-46115 described above.

Figure 2A:
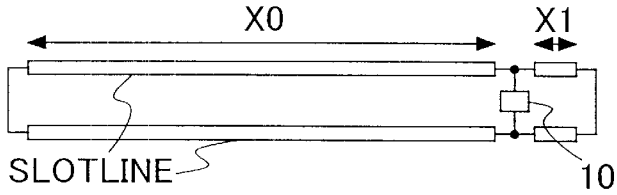
FIGS. 2A and 2B are equivalent circuit diagrams of assistance in explaining the operation of the slot antenna according to the present invention.
Figure 2B:
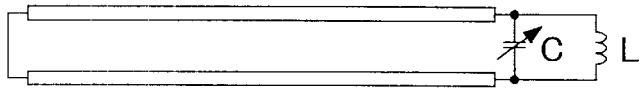
Figure 2C:
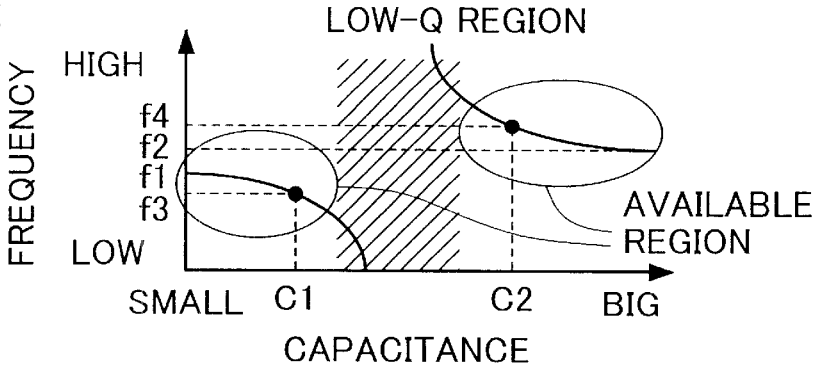
FIG. 2C is a resonant frequency characteristic diagram of assistance in explaining the operation of the slot antenna according to the present invention.

With reference to FIG. 2, there will be described a principle in which the impedance between the conductors on opposite edges of the slot in the first position is varied to change the resonant frequency. FIG. 2 shows equivalent circuits of the slot equipped with the variable impedance circuit and the resonant frequency characteristics. FIG. 2A is an equivalent circuit diagram of the slot. FIG. 2B is an equivalent circuit diagram of the slot in which the variable capacitance circuit is used as the variable impedance circuit of FIG. 2A, and the slotline from the first position to one of the ends of the slot is approximated by an inductance L. FIG. 2C is a resonant frequency characteristic diagram for a capacitance value C of the variable capacitance circuit in the equivalent circuit of FIG. 2B.

The resonant frequency of the slot antenna is almost inversely proportional to the length of the slotline. When the variable impedance circuit 10 is opened, the length of the slotline is X0+X1, and the resonant frequency is f1 shown in FIG. 2C. When the variable impedance circuit 10 is short-circuited, the slotline length is short and X0, and the resonant frequency is increased which is f2 shown in FIG. 2C. Suppose that the variable impedance circuit has a variable capacitance C, and the slotline from the first position to one of the ends of the slot 2 is approximated by the inductance L. Then, a synthetic inductance Z of C and L is shown by the following equation (1):

$$Z=j\,\omega L/(1-\omega^2 LC) \tag{1}$$

In the equation (1), since, to a certain value, the denominator is smaller as C is increased, Z appears to be a larger inductance component. When C is larger than the certain value, the denominator is negative, so that Z appears to be a small capacitance component. When C is further larger, Z is equal to the C value. With increased C, the resonant frequency starting from f1 is reduced, when the inductance component is increased, that is, the line length is equivalently increased from the X0+X1 length. When the capacitance component is increased from a certain capacitance value, that is, the line length approaches from the state where the line length is equivalently reduced from the X0 length to the X0 state, the resonant frequency is reduced from the radio frequency to f2 When the C value is increased, LC is in a resonant state in the region around the state where Z is moved from positive to negative. With even a slight amount of loss in the variable impedance circuit, the energy is consumed so that a resonant quality coefficient Q value of the antenna is reduced. Since this region is unsuitable for application as the antenna, a range excluding this region is a usable region of the tunable slot antenna of the present invention.

Using such characteristics, for example, the capacitance element having a small capacitance value C1 is connected between the conductors on opposite edges of the slot in the first position, so that the resonant frequency is reduced from f1 to f3. On the contrary, when the capacitance element having a large capacitance value C2 is connected in the same position, the resonant frequency can be increased from f1 to f4. According to the construction, the capacitance value connected between the conductors on opposite edges of the slot in the first position can set the resonant frequency of the antenna to a given value. At this time, since the variable impedance circuit 10 is connected near the end of the slot, it is sufficiently away from near the central portion of the slot having the largest radiated power of the antenna, without affecting the radiated power.

When the variable inductance circuit is connected between the conductors on opposite edges of the slot in the first position, the variable resonant frequency range is small as compared with the case that the variable capacitance circuit is connected to the same position. However, no resonance is caused between the slotline from the first position to one of the ends of the slot and the variable inductance circuit. No region reducing the Q value is caused by the inductance value of the variable inductance circuit.

Embodiment 2

Figure 3:
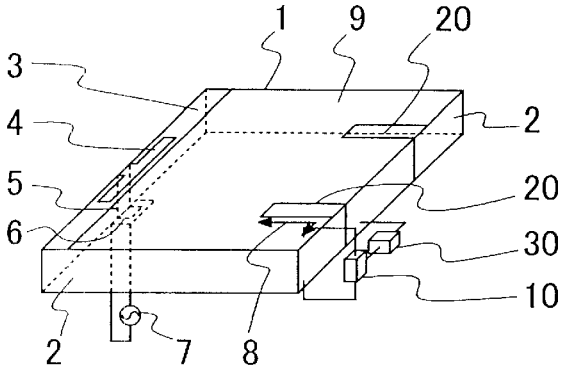
FIG. 3 is a perspective view of assistance in explaining a second embodiment of the slot antenna according to the present invention.

FIG. 3 shows an embodiment in which the end of the slot in Embodiment 1 is extended to the top surface of the conductive cubic 1. In the form for the slot, further, one portion of the conductor of the top surface of the conductive cubic is removed from near at least one of the ends of the slot, so as to form the slot extension portion in which the slot is extended the top surface of the conductive cubic. In FIG. 3, the conductor is removed from the top surface 9 of the conductive cubic 1, so as to form a slot extension portion 20 in which the end of the slot 2 is extended to the top surface 9 of the conductive cubic 1. According to this embodiment, the length of the slot for determining the resonant frequency of the slot antenna can be maintained, and the area of the conductive cubic 1 viewed from the top surface can be small, thereby making the antenna smaller. The entire length of the slot and the distance 8 from the first position to the end of the slot are varied, so as to change the resonant frequency of the slot antenna and an amount of the resonant frequency varied by the variable impedance circuit 10. According to this construction in which the slot extension portion 20 is provided in the top surface of the conductive cubic 1, the length of the slot extension portion 20 can easily be adjusted, so that the resonant frequency of the slot antenna and an amount of the varied resonant frequency can easily be adjusted.

Embodiment 3

Figure 4:
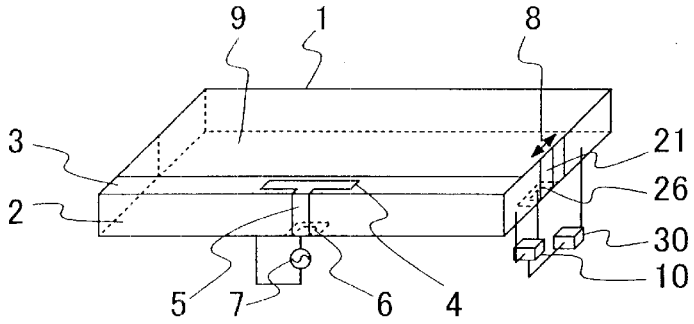
FIG. 4 is a perspective view of assistance in explaining a third embodiment of the slot antenna according to the present invention.

FIG. 4 shows an embodiment in which the variable impedance circuit 10 in Embodiment 1 is provided in the bottom surface of the conductive cubic 1. The conductor of the single side of the slot in the first position at the distance 8 away from one of the ends of the slot 2, and a second island conductor 26 provided in the lower surface of the conductive cubic 1 so as not to be in contact with the conductor of the lower surface, are connected by a strip conductor 21 provided in the slot 2.

One of a pair of the terminals of the variable impedance circuit 10 in which impedance between the terminals is varied is connected to the island conductor 26, and the other is connected to the conductor of the lower surface of the conductive cubic 1 near the island conductor 26. According to this embodiment, since the variable impedance circuit 10 can be provided in the lower surface of the conductive cubic 1 of the opposite side of the top surface of the conductive cubic 1 for radiating power, the influence of the variable impedance circuit 10 on the-radiated power can be reduced.

Embodiment 4

Figure 5:
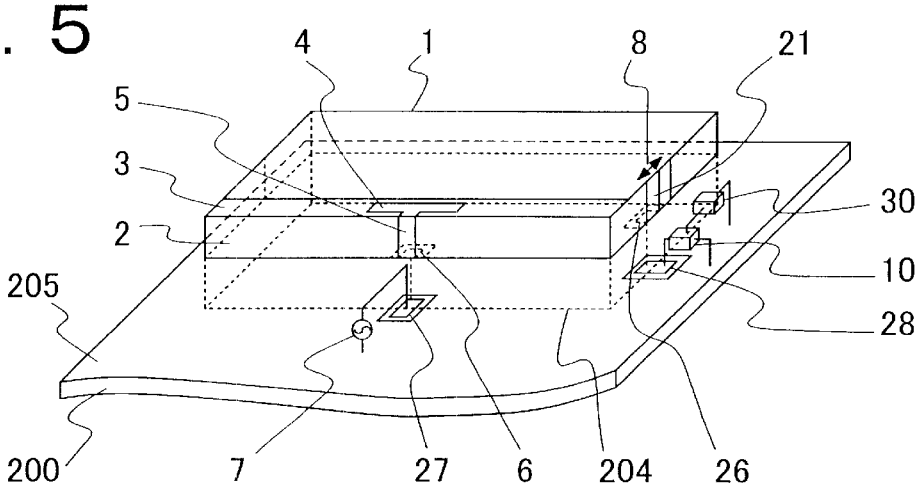
FIG. 5 is a perspective view of assistance in explaining a fourth embodiment of the slot antenna according to the present invention.

FIG. 5 shows a perspective view of one embodiment of the wireless handset according to the present invention. In this embodiment, the slot antenna of Embodiment 3 is mounted on the circuit board of the wireless handset.

Island conductors 27, 28 are provided on a circuit board 200 mounting the antenna so as not to be in contact with a ground conductor 205 provided in the surface mounting the antenna. When the antenna is mounted on an antenna mounting position 204, the island conductor 27 is connected to the first island conductor 6, the island conductor 28 is connected to the second island conductor 26, and the conductor of the lower surface of the conductive cubic 1 is connected to the ground conductor 205. The radio frequency power supply circuit 7 is connected between the island conductor 27 and the ground conductor 205, so as to supply power to the antenna. The variable impedance circuit 10 is connected between the island conductor 28 and the ground conductor 205. It is possible to mount at the same time the antenna and the variable impedance circuit 10 on the circuit board 200 mounting the antenna.

The antenna of this embodiment has effects of reducing the manufacture cost of the wireless handset adaptable by cutting the number of packaging processes, and of making the tunable slot antenna thinner by eliminating any parts mounted on the antenna.

The slot antennas of Embodiments 1 to 3 is magnetic current type antennas, but, as in this embodiment, is packaged in the ground plane, so as to have single-side directional on the opposite side of the ground plane viewed from the antenna. Since the magnetic current on the slot and the image magnetic current generated by the ground plane are in the same phase, the influence of the magnetic current is increased in the antenna direction viewed from the ground plane. In order to realize the single-side directional, the ground plane on the circuit board mounting the antenna may be used, and the antenna may be mounted on the shield case for electromagnetic shielding the radio frequency circuit. The single-side directional antenna is used. Thus, the wireless handset incorporating this antenna can package parts on the opposite side of the power radiation direction of the antenna. The packaging density is increased to make the wireless handset smaller.

Embodiment 5

Figure 6:
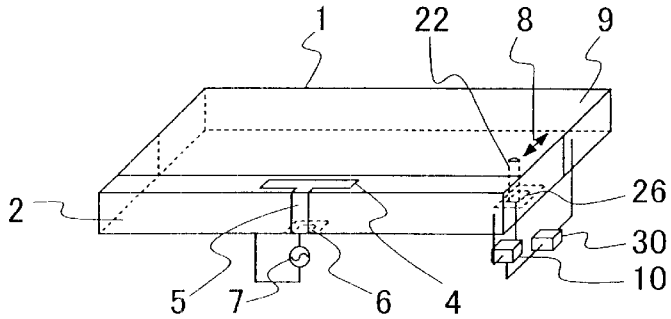
FIG. 6 is a perspective view of assistance in explaining a fifth embodiment of the slot antenna according to the present invention.

FIG. 6 shows an embodiment in which a through hole conductor is used in place of the strip conductor 21 provided in the slot 2 of the slot antenna in Embodiment 3. The conductor on the slot edge in the first position at the distance 8 away from one of the ends of the slot 2, and the island conductor 26 provided in the lower surface of the conductive cubic 1 so as not to be in contact with the conductor of the lower surface, are electrically connected by a through hole 22. One of a pair of the terminals of the variable impedance circuit 10 in which impedance between the terminals is varied is connected to the island conductor 26, and the other is connected to the conductor of the lower surface of the conductive cubic 1 near the island conductor 26.

According to this construction, as in Embodiment 3, the variable impedance circuit can be provided in the lower surface of the conductive cubic of the opposite side of the top surface of the conductive cubic for radiating power. The influence of the variable impedance circuit on the radiated power from the slot 2 can be reduced. In order to form the strip conductor 21, a more typical though hole conductor forming process can be used as compared with the process for forming the side surface conductor, thereby reducing the manufacture cost.

In the above-mentioned embodiment of the tunable slot antenna, as in the conventional tunable slot antenna proposed in Japanese Non-examined Patent Publication No. 11-46115 described above, a typical print circuit board manufacture process can be used for manufacture. The antenna is formed in the same circuit board as the radio frequency circuit board, so that the cost of parts and the manufacture cost of the wireless handset can be further reduced.

Embodiment 6

Figure 7:
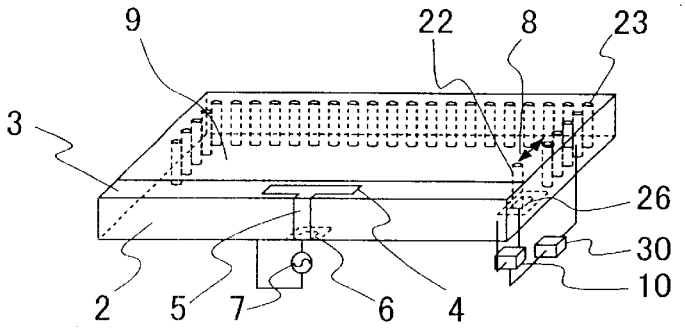
FIG. 7 is a perspective view of assistance in explaining a sixth embodiment of the slot antenna according to the present invention.

FIG. 7 shows an embodiment in which the top surface conductor and the lower surface conductor of the slot antenna of Embodiment 5 are connected by through hole conductors in place of the side surface conductor wall. In this embodiment, the side surface conductor of the conductive cubic connecting the top surface 9 conductor and the lower surface conductor of the conductive cubic are electrically connected by a plurality of through hole conductors 23 arranged at small intervals along the side surface of the antenna. When the space between the through hole conductors is sufficiently smaller than the wavelength of the electromagnetic wave transmitted or received by the antenna, these through hole conductors exhibit almost the same characteristic as that of the conductor wall contiguous with the electromagnetic wave. The interval between the through hole conductors in order to exhibit this characteristic may be below about 1/20 of the wavelength of the electromagnetic wave to be transmitted or received using the antenna.

According to this embodiment, when the antenna is manufactured by the print circuit board manufacture process, a more typical through hole conductor forming process can be used as compared with the process for forming the side surface conductor. The process for forming the conductor can be simplified, and the manufacture cost can be further reduced.

Embodiment 7

Figure 8:
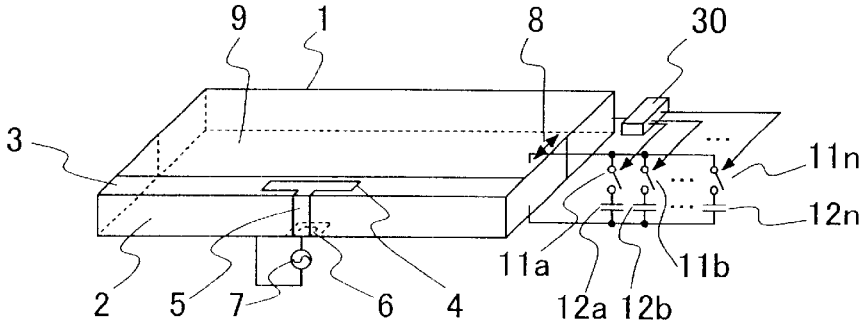
FIG. 8 is a perspective view of assistance in explaining a seventh embodiment of the slot antenna according to the present invention.

FIG. 8 shows an embodiment in which there are used a plurality of capacitance elements and switches connected in serial to the respective capacitance elements, as the variable impedance circuit 10 in Embodiment 1. In the drawing, one of the terminals of a switch 11*a* is connected to the conductor on the single edge of the slot in the first position at the distance 8 from one of the ends of the slot 2 to the other end along the slot 2, the other terminal of the switch 11*a* is connected to one of the terminals of a capacitance element 12*a*, and the other terminal of the capacitance element 12*a* is connected to the conductor forming the slot 2 of the opposite side of the side that one of the terminals of the switch is connected in the first position. Switches 11*b* to 11*n*, and capacitance elements 12*b* to 12*n* are connected in a similar manner. The switches 11*a*, 11*b* to 11*n* are controlled in the respective conductive/nonconductive states by the control circuit 30.

According to this embodiment, the impedance between the conductors on opposite edges of the slot at the distance 8 away from one of the ends of the slot 2 (capacitance value in this embodiment) can be varied to a large number of values, thereby realizing a large number of resonant frequencies. Since the antenna capable of realizing a large number of resonant frequencies can respond in detail to the frequency in the system bandwidth employing the antenna, the bandwidth of the antenna can be narrower, that is, the volume can be smaller. A plurality of capacitance elements and a plurality of switches used in this embodiment provide an integrated circuit, thereby making the antenna smaller.

Embodiment 8

Figure 9:
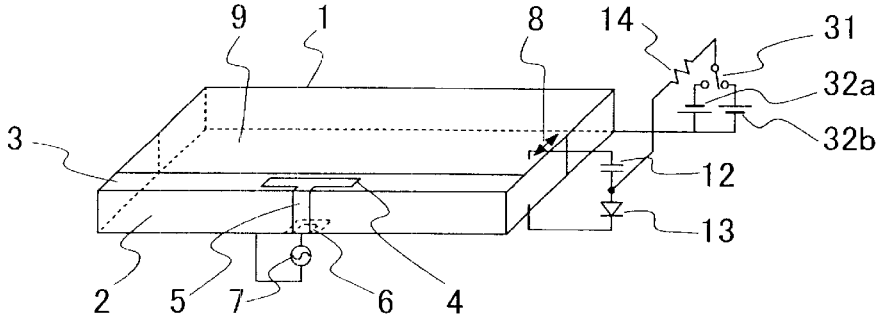
FIG. 9 is a perspective view of assistance in explaining an eighth embodiment of the slot antenna according to the present invention.

FIG. 9 shows an embodiment in which there are used a capacitance element and a PIN diode connected in serial thereto, as the variable impedance circuit in Embodiment 1. In the drawing, one of the terminals of a capacitance element 12 is connected to the conductor on the single edge of the slot in the first position at the constant distance 8 from one of the ends of the slot 2 to the other end along the slot, the other terminal of the capacitance element is connected to the anode terminal of a PIN diode 13, and the cathode terminal of the PIN diode is connected to the conductor forming the slot 2 of the opposite side of the side that one of the terminals of the capacitance element is connected in the first position. The anode terminal of the PIN diode 13 is connected to one of the terminals of a resistance element 14, and the other terminal of the resistance element is connected to a first terminal of a change-over switch 31 having three terminals. A second terminal of the change-over switch 31 is connected to a negative electrode of a DC power source 32*a* having a positive electrode connected to the conductive cubic 1, and a third terminal is connected to a positive electrode of a DC power source 32*b* having a negative electrode connected to the conductive cubic 1.

When the change-over switch 31 is set so as to cause the first terminal and the second terminal to become conductive, a negative DC voltage is applied to the PIN diode 13 through the resistance element 14. Then, the PIN diode 13 is in the reverse bias state, almost no direct current flows, and the DC voltage is applied to the PIN diode 13 almost directly. When the change-over switch 31 is set so as to cause the first terminal and the third terminal to be conductive, a positive DC voltage is applied to the PIN diode 13 through the resistance element 14. Then, the PIN diode 13 is in the forward bias state, that is, in the conductive state. Most of the DC voltage is applied to the resistance element 14, and a direct current determined by the DC voltage value and the resistance value of the resistance element 14 is applied to the PIN diode 13.

When the PIN diode 13 is in the reverse bias state, the PIN diode 13 appears to be a capacitance element having a very small capacitance value (typically below 1 pF), and is opened in radio frequency. The terminal connected to the anode terminal side of the PIN diode 13 of the capacitance element 12 is opened. There can be realized the state where nothing is electrically connected to the slot 2. When the PIN diode 13 is in the forward bias state, the PIN diode 13 appears to be a resistance element having a very small resistance value (typically below several ohms), and is almost short-circuited in radio frequency. The terminal connected to the anode terminal side of the PIN diode 13 of the capacitance element 12 is electrically connected to the conductor forming the slot 2 connected to the cathode terminal of the PIN diode 13 through the PIN diode 13. There can be realized the state where the capacitance of the capacitance value almost equal to that of the capacitance element 12 is connected between opposite terminals of the slot 2 in the first position at the constant distance 8 from one of the ends of the slot 2 to the other end along the slot 2. According to this embodiment, the change-over switch 31 can switch between the connection/non-connection state of the capacitance element 12 to the conductors of opposite edges of the slot in the first position, thereby switching the resonant frequency of the antenna.

Embodiment 9

Figure 10:
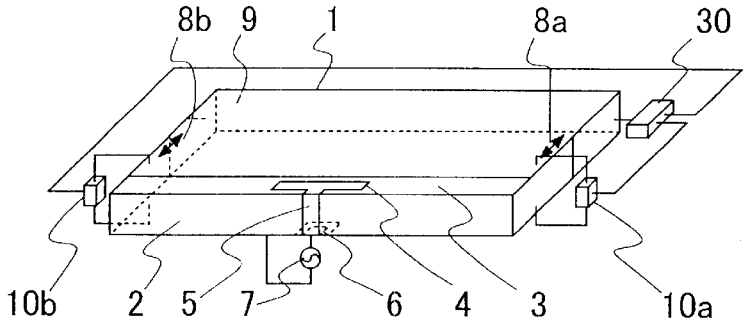
FIG. 10 is a perspective view of assistance in explaining a ninth embodiment of the slot antenna according to the present invention.

FIG. 10 shows an embodiment in which the variable impedance circuits in Embodiment 1 are provided at opposite ends of the slot.

In FIG. 10, a pair of terminals in which impedance between the terminals is varied in a first variable impedance circuit 10*a* is connected, respectively, to the conductors on opposite edges of the slot 2 in the first position at the constant distance 8*a* from one of the ends of the slot 2 to the other end along the slot 2. Then, the terminal having applied thereto a control signal for varying impedance between the terminals is connected to a control line from the control circuit 30.

The control signal supplied from the control circuit 30 can vary impedance between the terminals on opposite edges of the slot 2 in the first position. Similarly, a pair of terminals in which impedance between the terminals is varied in a second variable impedance circuit 10*b* is connected, respectively, to the conductors on opposite edges of the slot 2 in a second position at the constant distance 8 from the other end of the slot 2 to the one of the ends along the slot 2. Then, the terminal having applied thereto a control signal for varying impedance between the terminals is connected to a control line from the control circuit 30. The control signal supplied from the control circuit 30 can vary impedance between the conductors on opposite edges of the slot 2 in the second position.

In this embodiment, the resonant frequency of the antenna can be set to a large number of values. For example, each of the first and second variable impedance circuits 12*a*, 12*b* has two states of ON/OFF. When the resonant frequency in the ON state of the first variable impedance circuit 12*a* is different from that in the ON state of the second variable impedance circuit 12*b*, the resonant frequency can be set in four states such that both are OFF, both are ON, only the first variable impedance circuit 12*a* is ON, and only the second variable impedance circuit 12*b* is ON. In order that the resonant frequency in the ON state of the first variable impedance circuit 12*a* is different from that of the ON state of the second variable impedance circuit 12*b*, the circuit may be designed such that the positions in which the respective circuits are connected at opposite ends of the slot 2, that is, the distances 8*a*, 8*b* from the end of the slot 2 are different, or the impedance values realized when the respective circuits are ON are different.

In order to increase the states where the resonant frequency can be obtained, as in Embodiment 6, the variable impedance circuit may be a circuit exhibiting a change in a large number of capacitance values, or a third or fourth variable impedance circuit may be provided in different positions of the slot 2.

Embodiment 10

Figure 11:
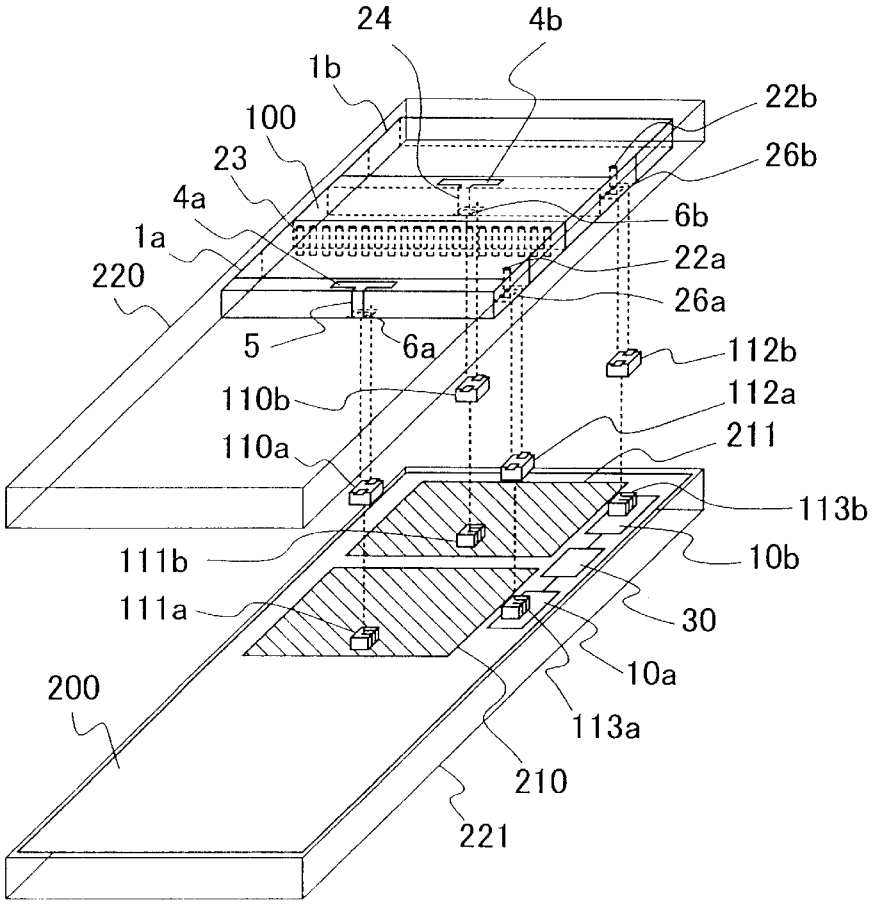
FIG. 11 is a perspective view of assistance in explaining a first embodiment of a wireless handset according to the present invention.

FIG. 11 shows a perspective view of another embodiment of the wireless handset according to the present invention.

In FIG. 11, the transmit/receive slot antennas are mechanically connected by a support 100 so as to align the directions of the main polarizations. In this embodiment, in a conductive cubic la constructing the transmit slot antenna, the side surface opposite the power supply conductor 5 is connected by the plurality of through holes 23 in place of the conductive wall. An island conductor 6*a* connected to the power supply conductor 5 of the transmit slot antenna, and the conductor of the lower surface of the conductive cubic around the island conductor, are connected to a connector 110*a*, and are connected to a connector 111*a* provided in a transmit circuit 210, so as to supply power from the transmit circuit.

An island conductor 6*b* as the power supply conductor of the receive slot antenna connected to a through hole 24, and the conductor of the lower surface of the conductive cubic around the island conductor, are connected to a connector 10*b*, and are connected to a connector 111*b* provided in a receive circuit 211, so as to supply power to the receive circuit. The conductor on the slot edge in the first position at the constant distance from one of the ends of the slot of the transmit slot antenna, and an island conductor 26*a* provided in the lower surface of the conductive cubic la so as not to be in contact with the conductor of the lower surface of the conductive cubic, are connected by a through hole conductor 22*a*. Then, the variable impedance circuit 10*a* provided on the circuit board 200 is connected through connectors 112*a*, 113*a* between the island conductor 26*a* and the conductor of the lower surface of the conductive cubic around the island conductor.

Similarly, the conductor on the slot edge in the second position at the constant distance from one of the ends of the slot of the receive slot antenna 1*b*, and an island conductor 26*a* provided in the lower surface of the conductive cubic 1*b* so as not to be in contact with the conductor of the lower surface of the conductive cubic, are connected by a through hole conductor 22*b*. Then, the variable impedance circuit 10*b* provided on the circuit board 200 is connected though connectors 112*b*, 113*b* between an island conductor 26*b* and the conductor of the lower surface of the conductive cubic around the island conductor. The variable impedance circuits 10*a*, 10*b* are connected to the control circuit 30, so that the control circuit controls the resonant frequency of the transmit/receive slot antennas. The transmit/receive slot antennas and the circuit board are interposed by a rear case 220 and a front case 221, so as to construct a wireless handset incorporating the antenna. The reference numerals 4*a*, 4*b* in the drawing denote matching conductors provided in the slots of the transmit/receive antennas.

According to this embodiment, the volume of the antenna is typically proportional to the bandwidth. As compared with the volume of the antenna having a bandwidth covering the whole transmit/receive bandwidth provided by interposing the transmit/receive isolation bandwidth, the volume of the antenna covering the transmit/receive bandwidths can be reduced by more than half, so that the antenna volume in total can be reduced, thereby making the wireless handset incorporating the antenna smaller. The antenna used in this embodiment is a slot antenna as a magnetic current type antenna. The ground plane is provided in the circuit board 200 mounting the antenna, and then the antenna is mounted in the surface facing the opposite side of the user when using the wireless handset. Thus, electric power can effectively be radiated to the opposite side of the user, In addition, even when the circuit is packaged in the wireless handset case on the wireless handset user side viewed from the antenna, the radiated power is not affected. The packaging density can be high, and the wireless handset can be smaller.

Further, according to this embodiment, the resonant frequency of the transmit/receive slot antennas can be controlled. The transmit/receive slot antennas have the narrower transmit/receive bandwidths without a bandwidth covering the whole transmit/receive bandwidth. The resonant frequency may be controlled to cover the whole transmit/receive bandwidth. The antenna volume is reduced so as to make the wireless handset smaller. In this embodiment, the antennas are provided for transmit/receive. It is unnecessary to use a duplexer for isolating transmit/receive frequency signals from each other required when a transmit/receive sharable antenna is used in the wireless handset for calling at the same time at different transmit/receive frequencies, Typically, the duplexer is one of the largest part among the radio frequency circuit parts. When the duplexer is eliminated, the wireless handset can be smaller.

Furthermore, according to this embodiment, the transmit/receive antennas are connected by the support so as to align the directions of the main polarizations. The directions of the main polarizations of the transmit/receive antennas can be aligned to the directions of the polarizations used in the system employing the wireless handset equipped with the antenna, so as to efficiently perform transmit/receive. The distance between transmit/receive antennas is maintained constant by the support. An amount between the transmit/receive antennas isolated is constant regardless of how to mount the antenna, so as to give stable properties.

The transmit/receive antennas of this construction are a single-layer plate construction without having in its interior a conductor pattern. The transmit/receive antennas and the support are integrally formed using a print circuit board having opposite surfaces covered with copper. The manufacture cost can be reduced as compared with the case where the transmit/receive antennas are manufactured independently to be combined.

Embodiment 11

Figure 12:
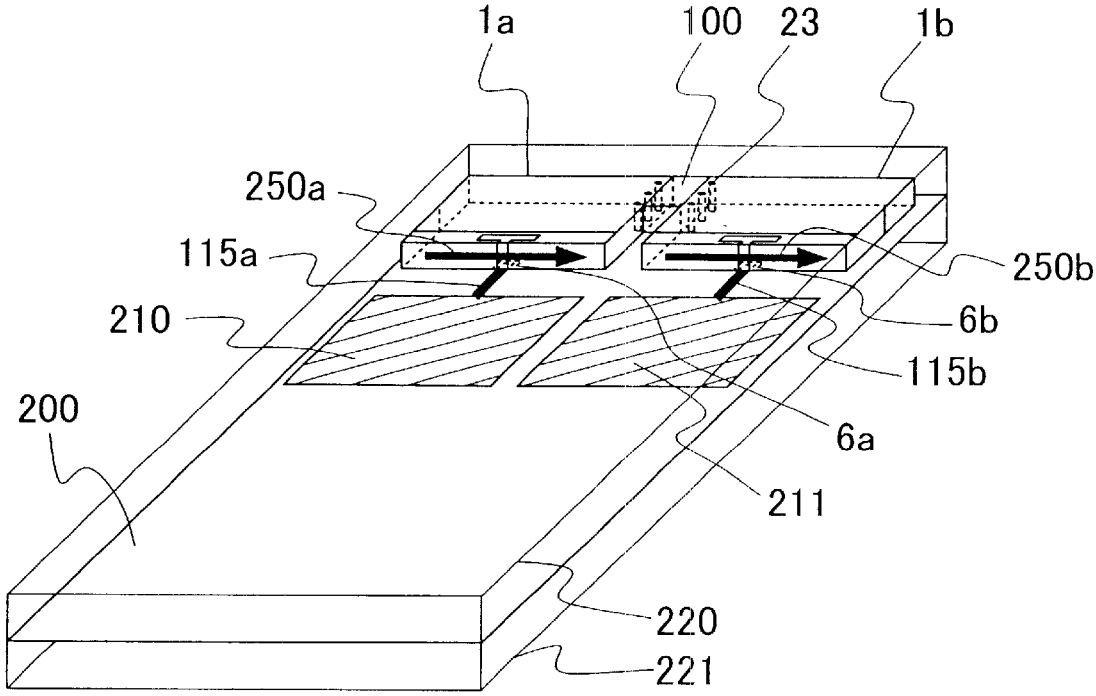
FIG. 12 is a perspective view of assistance in explaining a second embodiment of the wireless handset according to the present invention.

FIG. 12 shows a perspective view of an embodiment of the wireless handset mounting the transmit/receive slot antennas in parallel in Embodiment 10.

Parts of the side surface conductors forming conductive cubics 1*a*, 1*b* of the transmit/receive slot antennas are substituted by a plurality of the though holes 23, and then the side surfaces provided with the though holes 23 are connected by the support 100. The island conductors 6*a*, 6*b* as the power supply points of the transmit/receive slot antennas are connected, respectively, to the transmit circuit 210 and the receive circuit 211 by signal lines 115*a*, 115*b*.

The slot antennas are magnetic current type antennas. The directions of the magnetic currents on the antennas are shown by arrows 250*a*, 250*b* of FIG. 12. When a plurality of magnetic current type antennas are arranged such that the magnetic currents are in a straight line, the combination between the antennas can be minimized. As shown in FIG. 12, two magnetic current type antennas are arranged such that the main polarization planes are corresponded to each other, and the magnetic currents are in a straight line. Thus, the main polarization planes required for transmit/receive can be maintained, while the combination between the transmit/receive antennas can be minimized. It is possible to reduce leak of the signal from the transmit radio frequency circuit to the receive radio frequency circuit in the wireless handset for performing transmit/receive at the same time.

When the transmit/receive slot antennas and the support are integrally formed, it is convenient to form the support with a dielectric identical to the dielectric supporting the conductive cubics constructing the slot antennas and the power supply conductor. However, when the dielectric is present between the slots of the transmit/receive slot antennas, the electric distance between the slots of the portion in which the dielectric is present is equivalently reduced, so that the electromagnetic interference is increased. In this embodiment, the transmit/receive slot antennas are connected by the support 100 in the portion other than the slots of the transmit/receive slot antennas. This can prevent the electromagnetic interference between the transmit/receive slot antennas from being increased.

Embodiment 12

Figure 13:
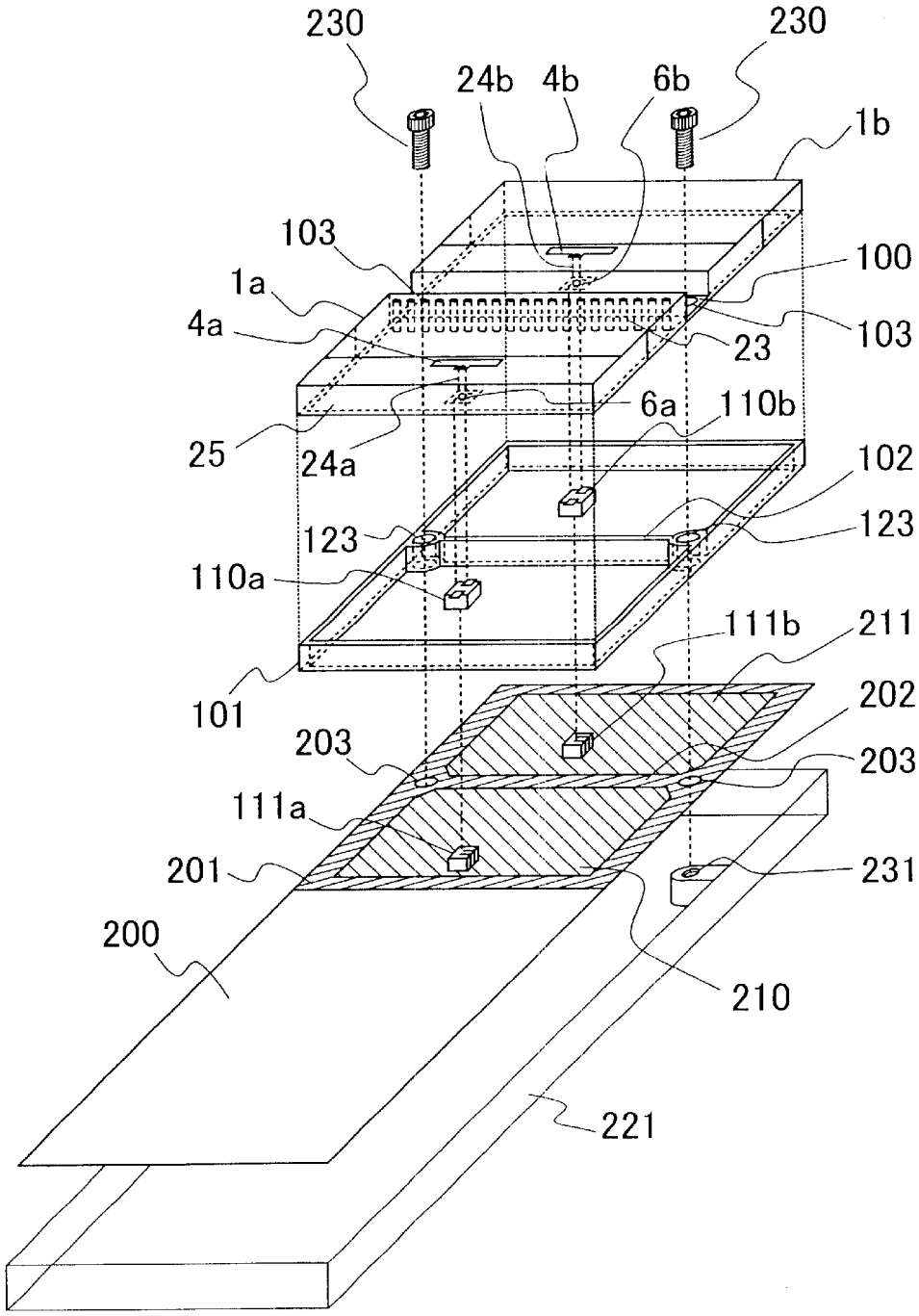
FIG. 13 is a perspective view of assistance in explaining a third embodiment of the wireless handset according to the present invention.
Figure 14:
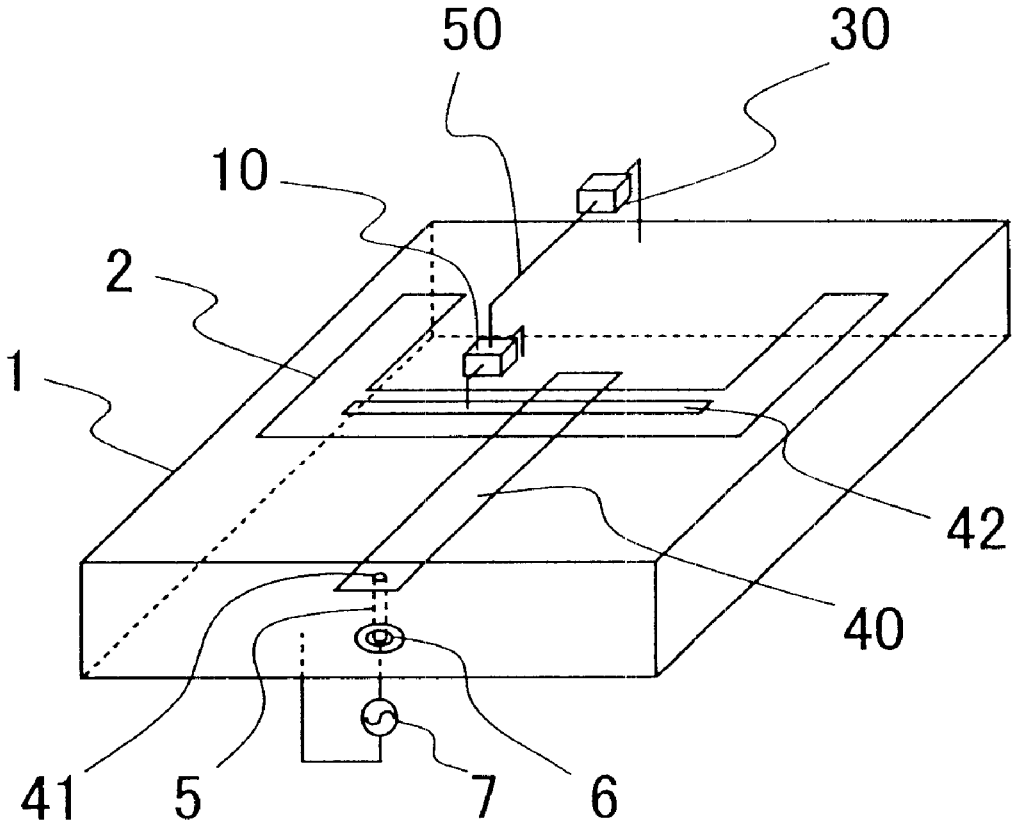
FIG. 14 is a perspective view of assistance in explaining a conventional tunable slot antenna.

FIG. 13 is a perspective view showing the construction of another embodiment of the wireless handset according to the present invention. In this embodiment, an opposed conductive plane is formed on the surface opposite the circuit board mounting the transmit/receive slot antennas and the antenna for the support connecting both. Then, the opposed conductive plane and a peripheral ground conductive pattern provided around the transmit/receive radio frequency circuits disposed in the surface of the circuit board mounting the antenna, are connected by a shield conductive wall provided so as to surround the transmit/receive radio frequency circuits. In FIG. 13, the rear case constructing the wireless handset case is omitted.

The conductive plane is provided in the surface of the support 100 for connecting the transmit/receive slot antennas opposite the circuit board 200. The conductor of the lower surface of the conductive cubic la constructing the transmit slot antenna is connected to the conductor of the lower surface of the conductive cubic 1*b* constructing the receive slot antenna, so as to form an opposed conductive plane 25. A peripheral ground conductive pattern 201 is provided around the transmit/receive radio frequency circuits 210, 211 disposed in the surface of the circuit board 200 equipped with the antenna. The opposed conductive plane 25 and the peripheral ground conductive pattern 201 are electrically connected by a shield conductive wall 101 provided so as to surround the transmit/receive radio frequency circuits. The circuit board 200 has in its inner layer the ground plane electrically connected to the peripheral ground conductive pattern 201, which is not illustrated.

In this embodiment, drill holes 103, 123 and 203 are provided in the transmit/receive slot antennas connected by the support 100, the shield conductive wall 101, and the circuit board 200, respectively. Screws 230 though the drill holes are screwed into screw holes 231 provided in the front case 221. Thus, the antennas and the circuit board can be fixed to the wireless handset case, and the opposed conductive plane 25, the shield conductive wall 101, and the peripheral ground pattern 201 can be electrically connected. The fixing and electric connection can also be realized by a fitting construction using nails without screws.

According to this embodiment, the opposed conductive plane, the shield conductive wall, the peripheral ground pattern, and the ground plane of the circuit board inner layer can electromagnetically shield the transmit/receive radio frequency circuits. A new shield case must not be added, so that the properties of the wireless handset can be improved inexpensively. In this embodiment, the transmit/receive radio frequency circuits can be shielded electromagnetically, not only the transmit/receive radio frequency circuits, but also the logic circuit and the power source circuit may be shielded electromagnetically.

Further, according to this embodiment, an isolation ground conductive pattern 202 electrically connected to the ground plane provided in the circuit board is provided between the transmit radio frequency circuit 210 and the receive radio frequency circuit 211. An isolation conductive wall 102 is provided in the space formed with the opposed conductive plane 25, the shield conductive wall 101, and the surface of the circuit board 200, so as to electrically connect the opposed conductive plane 25 and the isolation ground conductive pattern 202 by the isolation conductive wall 102. This can isolate the transmit radio frequency circuit 210 and the receive radio frequency circuit 211 form each other while being shielded electromagnetically, Thus, it is possible to reduce the electromagnetic interference between the transmit/receive radio frequency circuits. In particular, the wireless handset for performing transmit/receive at the same time can effectively improve the properties of the wireless handset. In this embodiment, the transmit/receive radio frequency circuits are isolated from each other. With this construction, it is possible to isolate from other circuits a circuit such as a frequency synthesizer circuit or a transmit power amplifier, which can easily be affected by the other circuits, or easily affect the other circuits.

The entire shield conductive wall 101 and the entire isolation conductive wall 102 must not be a conductor, and may be an insulator having a surface covered with a conductor. The transmit/receive slot antennas, the support 100 for both, and the shield conductive wall 101 may be manufactured independently. However, for example, it is possible to integrally form them as a three-dimensional molding circuit part by injection molding technique, and the integral molding can reduce the number of parts, so as to cut the assembling cost. In FIG. 13, the numerals 24*a*, 24*b* denote through hole conductors as the power supply conductor for the transmit/receive slot antennas.

According to the present invention, the conductive cubic, the slot provided in the side surface of the conductive cubic, and the power supply conductor provided in the slot, can construct the slot antenna without having in its inner layer the conductive pattern, so as to reduce the manufacture cost.

Further, according to the present invention, the small slot antenna to equivalently expand the bandwidth by varying the resonant frequency, can be realized by connecting the variable impedance circuit on opposite edges of the slot in the position at the constant distance from the slot end. Thus, the variable impedance circuit required for varying the resonant frequency must not be provided in the central portion of the slot and the top surface of the antenna affecting the radiated power of the antenna, without affecting the radiated power.

Furthermore, according to the present invention, in the wireless handset fir use in a communication system switching a plurality of call frequencies and employing different transmit/receive frequencies, the transmit and receive antennas are connected by the support so as to align the directions of the main polarizations. The antenna system can be constructed by a volume smaller than the volume of the antenna having a bandwidth covering the whole transmit/receive bandwidth provided by interposing the transmit/receive isolation bandwidth, so as to make the handset smaller. The directions of the main polarizations of the transmit/receive antenna are aligned to the directions of the polarizations for use in the system employing the wireless handset equipped with the antenna, so as to efficiently perform transmit/receive. The distance between the transmit/receive antennas can be kept constant by the support. Thus, an amount of the transmit/receive antennas isolated can be constant regardless of how to mount the antenna, so as to give stable properties.

What is claimed is:

1. A wireless handset comprising a circuit board having a ground plane, and a side surface slot antenna packaged in the circuit board, the side surface slot antenna comprising a flat conductive cube covered with a conductor, said cube having top and lower wide surfaces and narrow side surfaces between the top and lower wide surfaces, a slot having its main portion formed in one of the narrow side surfaces of the conductive cube, a power supply conductor disposed in the slot in the direction intersecting the longitudinal direction of the slot, and a power supply portion for supplying AC power to one of the ends of the power supply conductor.

2. The wireless handset according to claim 1, wherein the side surface slot antenna has a slot extension portion in which the slot end is extended to the top surface of the conductive cube.

3. The wireless handset according to claim 1, wherein the side surface slot antenna is provided in the slot with a strip matching conductor along the slot edge closer to the top surface of the conductive cube so as to be insulated from the conductor of the conductive cube, and the matching conductor is connected to the other end of the power supply conductor.

4. The wireless handset according to claim 3, wherein the side surface slot antenna comprises a slot extension portion in which the conductor of the top surface of the conductive cube is removed near the other end of the power supply conductor, and the slot is extended in the top surface of the conductive cube, the slot extension portion being provided with the matching conductor.

5. The wireless handset according to claim 1, wherein the side surface slot antenna is provided, in at least one of the ends of the slot, with a variable impedance circuit connected between the conductor on the single edge of the slot of the top surface of the conductive cube and the conductor of the lower surface of the conductive cube, and a control circuit for varying impedance of the variable impedance circuit.

6. The wireless handset according to claim 5, wherein the plurality of variable impedance circuits are provided in one of the ends or opposite ends of the slot, and are connected between the conductor on the single edge of the slot of the top surface of the conductive cube and the conductor of the lower surface of the conductive cube in the first position at the constant distance from one of the ends of the slot to the other end along the slot, and wherein amounts of the impedance variable of the plurality of variable impedance circuits and/or the first positions connected, respectively, to the plurality of variable impedance circuits, are different.

7. The wireless handset according to claim 5, wherein a ground conductor and a plurality of island conductors formed so as not to be in contact with the ground conductor are provided on the circuit board of the wireless handset on the surface mounting the side surface slot antenna, for the conductor of the lower surface of the conductive cube of the side surface slot antenna, a first island conductor not in contact with the conductor of the lower surface is provided in the lower surface in a portion in which one portion of the slot is extended to the lower surface of the conductive cube, the second island conductor not in contact with the conductor of the lower surface is provided in the lower surface and electrically connected with the single edge of the slot of the top surface of the conductive cube in the first position, the conductor of the lower surface of the conductive cube is connected to the ground conductor on the circuit board, the first and second island conductors provided in the lower surface of the conductive cube are connected to the respective island conductors on the circuit board, so as to supply AC power between the island conductor on the circuit board connected to the first island conductor and the ground conductor on the circuit board, and to connect the variable impedance circuit between the island conductor on the circuit board connected to the second island conductor and the ground conductor on the circuit board.

8. A wireless handset for use in a communication system switching a plurality of call frequencies and employing different transmit/receive frequencies and employing different transmit/receive frequencies, the wireless handset comprising a circuit board having a ground plane, and side surface slot antennas for transmit and receive, independently, the transmit/receive slot antennas being integrally formed by interposing a support so as to align the directions of the main polarizations and being mounted such that a lower surface of a conductive cube of each of the transmit/receive antennas is directed to the surface of the circuit board opposite the user when using the wireless handset, the transmit/receive slot antennas each comprising a flat conductive cube covered with a conductor, a slot having its main portion formed in the side surface of the conductive cube, a power supply conductor disposed in the slot in the direction intersecting the longitudinal direction of the slot, and a power supply portion for supplying AC power to one of the ends of the power supply conductor.

9. The wireless handset according to claim 8, wherein the conductive cube has top and lower wide surfaces and narrow side surfaces between the top and lower wide surfaces, and wherein the slot has its main portion formed in one of the narrow side surfaces.

10. The wireless handset according to claim 8, wherein the side surface slot antenna has a slot extension portion in which the slot end is extended to the top surface of the conductive cube.

11. The wireless handset according to claim 10, wherein the conductive cube has top and lower wide surfaces and narrow side surfaces between the top and lower wide surfaces, and wherein the slot has its main portion formed in one of the narrow side surfaces.

12. The wireless handset according to claim 8, wherein the side surface slot antenna is provided in the slot with a strip matching conductor along the slot edge closer to the top surface of the conductive cube so as to be insulated from the conductor of the conductive cube, and the matching conductor is connected to the other end of the power supply conductor.

13. The wireless handset according to claim 12, wherein the conductive cube has top and lower wide surfaces and narrow side surfaces between the top and lower wide surfaces, and wherein the slot has its main portion formed in one of the narrow side surfaces.

14. The wireless handset according to claim 8, wherein the side surface slot antenna is provided, in at least one of the ends of the slot, with a variable impedance circuit connected between the conductor on the single edge of the slot of the top surface of the conductive cube and the conductor of the lower surface of the conductive cube, and a control circuit for varying impedance of the variable impedance circuit.

15. The wireless handset according to claim 14, wherein the conductive cube has top and lower wide surfaces and narrow side surfaces between the top and lower wide surfaces, and wherein the slot has its main portion formed in one of the narrow side surfaces.

16. The wireless handset according to claim 8, wherein a conductive plane is provided in a surface of the support opposite the circuit board, the conductive plane and the conductor of the lower surface of the conductive cube of each of the transmit/receive slot antennas are connected so as to form the opposed conductive plane opposite the surface of the circuit board facing the opposite side of the user when using the wireless handset, a peripheral ground conductive pattern electrically connected to the ground conductive plane is provided around a specific circuit provided on a surface of the circuit board opposite the support, and the opposed conductive plane and the peripheral ground conductive pattern are electrically connected by a shield conductive wall provided so as to surround the specific circuit.

17. The wireless handset according to claim 16, wherein the conductive cube has top and lower wide surfaces and narrow side surfaces between the top and lower wide surfaces, and wherein the slot has its main portion formed in one of the narrow side surfaces.

18. The wireless handset according to claim 16, wherein an isolation ground conductive pattern electrically connected to the ground conductive plane is provided in the surface of the circuit board facing the opposite side of the user when using the wireless handset so as to isolate the specific circuit, an isolation conductive wall is provided in the space formed with the opposed conductive plane, the shield conductive wall, and the surface of the circuit board facing the opposite side of the user when using the wireless handset, and the opposed conductive plane and the isolation ground conductive pattern are electrically connected by the isolation conductive wall, so as to isolate the specific circuit into a plurality of portions.

19. The wireless handset according to claim 18, wherein the conductive cube has top and lower wide surfaces and narrow side surfaces between the top and lower wide surfaces, and wherein the slot has its main portion formed in one of the narrow side surfaces.

* * * * *